US008539614B2

(12) United States Patent
Cote

(10) Patent No.: US 8,539,614 B2
(45) Date of Patent: Sep. 24, 2013

(54) BILLIARD GLOVES

(76) Inventor: Nancy L. Cote, Manchester, NH (US)

( * ) Notice: Subject to any disclaimer, the term of this patent is extended or adjusted under 35 U.S.C. 154(b) by 0 days.

(21) Appl. No.: 12/200,310

(22) Filed: Aug. 28, 2008

(65) Prior Publication Data

US 2009/0158486 A1 Jun. 25, 2009

Related U.S. Application Data

(60) Provisional application No. 61/008,898, filed on Dec. 22, 2007, provisional application No. 61/011,830, filed on Jan. 22, 2008.

(51) Int. Cl.
*A41D 19/00* (2006.01)

(52) U.S. Cl.
USPC ..... 2/161.1; 2/163; 2/21; 473/2; 473/43

(58) Field of Classification Search
USPC ..... 2/21, 161.1, 163; 223/101; 273/108.5, 273/129 L; 473/2, 43
See application file for complete search history.

(56) References Cited

U.S. PATENT DOCUMENTS

| | | | | | |
|---|---|---|---|---|---|
| 1,235,199 | A | * | 7/1917 | Gavin | 2/21 |
| 1,362,461 | A | * | 12/1920 | Anast | 2/21 |
| 1,416,001 | A | * | 5/1922 | Detwiler | 2/21 |
| 1,483,595 | A | * | 2/1924 | Read | 473/205 |
| 2,538,889 | A | * | 1/1951 | Swarin | 2/21 |
| 2,751,592 | A | * | 6/1956 | Longstreth et al. | 2/21 |
| 3,544,111 | A | | 12/1970 | Crisman et al. | |
| D243,292 | S | * | 2/1977 | Koehler | D29/113 |
| 4,025,962 | A | | 5/1977 | Hartung | |
| 4,064,563 | A | | 12/1977 | Stokes | |
| 4,573,220 | A | * | 3/1986 | Baker | 2/161.1 |
| 4,689,828 | A | | 9/1987 | Brewer | |
| 4,751,747 | A | * | 6/1988 | Banks et al. | 2/21 |
| 4,796,302 | A | * | 1/1989 | Davis et al. | 2/21 |
| D316,916 | S | * | 5/1991 | James | D29/117.1 |
| D349,364 | S | * | 8/1994 | Rasmussen | D29/113 |
| 5,363,508 | A | | 11/1994 | Kim | |
| 5,706,520 | A | | 1/1998 | Thornton et al. | |
| D393,934 | S | | 4/1998 | Harvey | |
| D400,308 | S | | 10/1998 | Paparella et al. | |
| 6,145,128 | A | * | 11/2000 | Suzuki | 2/21 |
| 6,216,276 | B1 | * | 4/2001 | Eibert | 2/161.2 |
| 6,684,406 | B2 | * | 2/2004 | Fowler | 2/16 |
| 6,687,911 | B2 | * | 2/2004 | Fitz | 2/21 |
| 6,742,190 | B1 | | 6/2004 | Tobelmann | |
| 6,807,681 | B2 | | 10/2004 | Sorrels | |
| 6,925,653 | B1 | * | 8/2005 | King | 2/21 |
| D524,489 | S | | 7/2006 | Scott | |
| 7,127,771 | B2 | * | 10/2006 | McDevitt et al. | 15/227 |

(Continued)

FOREIGN PATENT DOCUMENTS

JP 2001-115318 4/2001

*Primary Examiner* — Khoa Huynh
*Assistant Examiner* — Sally Haden
(74) *Attorney, Agent, or Firm* — Grossman, Tucker, Perreault & Pfleger, PLCC

(57) ABSTRACT

A billiard glove and a method of forming a billiard glove including a first finger sheath, wherein the first finger sheath is configured to cover at least a portion of a first finger, a second finger sheath, wherein the second finger sheath is configured to cover at least a portion of a second finger; and a strip having a first portion and a second portion, wherein said first portion is affixed to the first finger sheath and the second portion is attached to the second finger sheath.

15 Claims, 9 Drawing Sheets

(56) References Cited

U.S. PATENT DOCUMENTS

| | | | | | |
|---|---|---|---|---|---|
| D553,301 | S | * | 10/2007 | Van Buren | D29/117.1 |
| 2003/0208833 | A1 | | 11/2003 | Gold | |
| 2005/0229286 | A1 | * | 10/2005 | Tseng et al. | 2/161.2 |
| 2008/0066210 | A1 | * | 3/2008 | Berry et al. | 2/21 |
| 2008/0276341 | A1 | * | 11/2008 | Duby | 2/16 |
| 2009/0025120 | A1 | * | 1/2009 | Vestling | 2/161.1 |

* cited by examiner

BILLIARD GLOVES

CROSS REFERENCES TO RELATED APPLICATIONS

This application claims the benefit of the filing dates of U.S. Provisional Application No. 61/008,898 filed on Dec. 22, 2007, and U.S. Provisional Application No. 61/011,830 filed on Jan. 22, 2008, the disclosures of which are incorporated herein by reference.

FIELD OF THE INVENTION

The present invention relates generally to billiard gloves and more specifically, to billiard gloves that cover at least a portion of a player's thumb, forefinger, and optionally additional fingers.

BACKGROUND

Billiard games or cue sports may utilize a cue, such as a one or two piece elongated stick, which may be tapered, to move objects, such as billiard balls around a table. During the game, one end of the cue may be slid through the fingers of one hand, which may be used to guide the cue, by the force of the second hand, pushing the other end of the cue. The cue may then strike a ball or other object on the table.

However, during play, the cue stick may catch or become stuck against the fingers of the guiding hand, which may cause an uneven stroke and/or errors in a shot. This may happen due to, for example, a person's skin texture or sweat on the hand. A number of gloves are available; however, many may cover the palm and other areas of the hand, preventing exposure of those portions of the hand to the environment. Exposure may aid in breathability or evaporation of sweat and feeling the table around the hand to understand the properties of the table, such as the texture of the baise.

SUMMARY OF THE INVENTION

An aspect of the present disclosure relates to a billiard device that may include a first finger sheath, wherein the first finger sheath is configured to cover at least a portion of a first finger, a second finger sheath, wherein the second finger sheath is configured to cover at least a portion of a second finger, and a strip having a first portion and a second portion, wherein the first portion is affixed to the first finger sheath and the second portion is attached to the second finger sheath.

Another aspect of the present disclosure relates to a billiard glove. The glove may include a first tapered finger sheath, wherein said first finger sheath may be configured to cover at least a portion of a thumb and expose the tip of said thumb and a second tapered finger sheath, wherein the second finger sheath is configured to cover at least a portion of a forefinger and expose the tip of said forefinger. In addition the sheaths each include a first edge and a second edge opposing the first edge, wherein the edges are folded edges and the sheaths include an external fabric layer and an internal foam layer. In addition, a strip may be attached to the first and second sheaths.

A further aspect of the present disclosure relates to a method of forming a billiard glove. The method may include cutting at least two finger sheath pieces and a strip piece from a material, hemming the pieces at opposing edges, affixing the strip piece to the sheath pieces, and forming the sheath pieces into tubular sheaths.

BRIEF DESCRIPTION OF THE DRAWINGS

The above-mentioned and other features of this disclosure, and the manner of attaining them, may become more apparent and better understood by reference to the following description of embodiments described herein taken in conjunction with the accompanying drawings, wherein.

DETAILED DESCRIPTION

Figure 1:
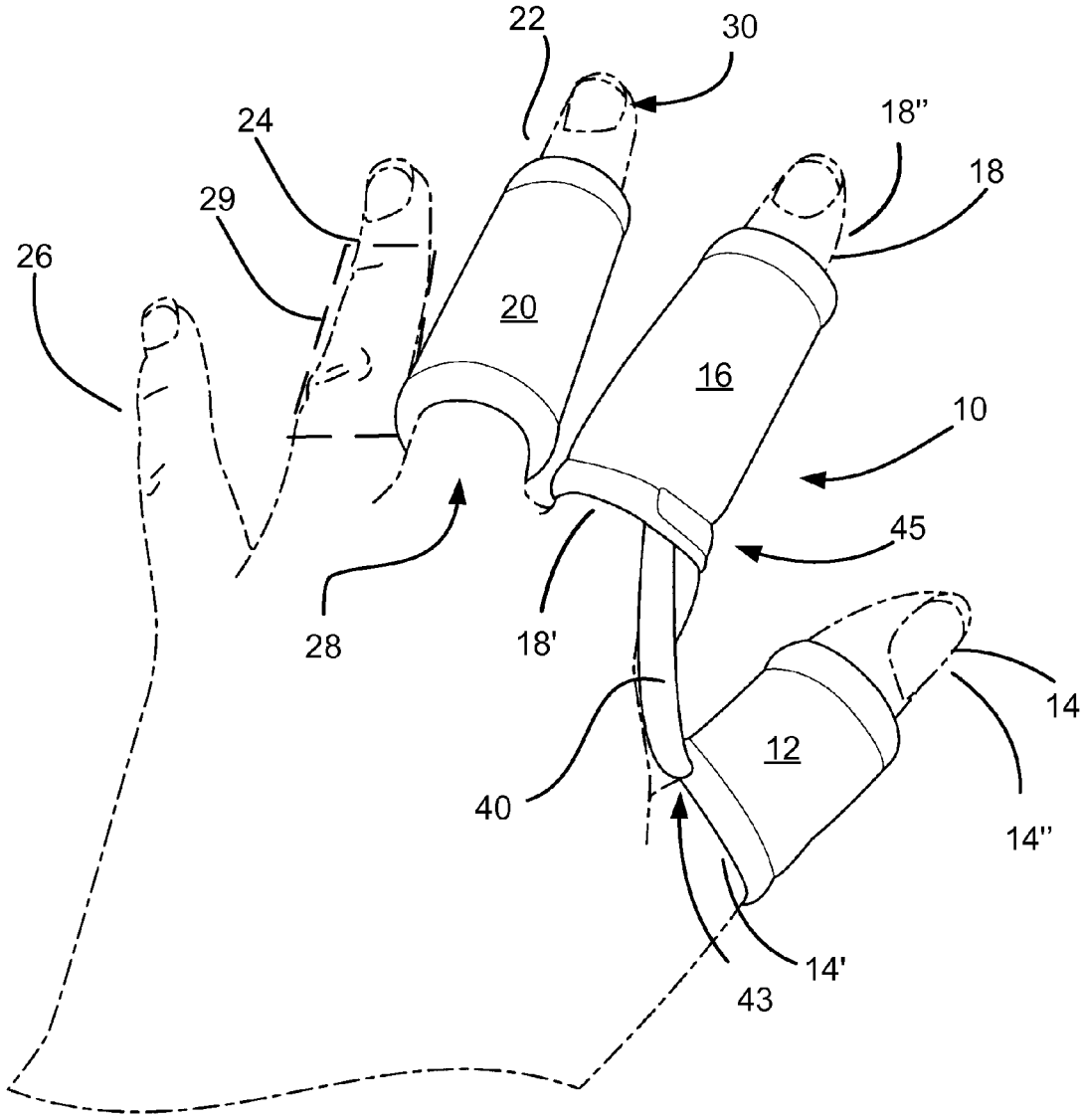
FIG. 1 illustrates a front perspective view of an example of a glove in the environment of a hand.

It may be understood that the disclosure herein may not be not limited in its application to the details of construction and the arrangement of components set forth in the following description or illustrated in the drawings. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 2:
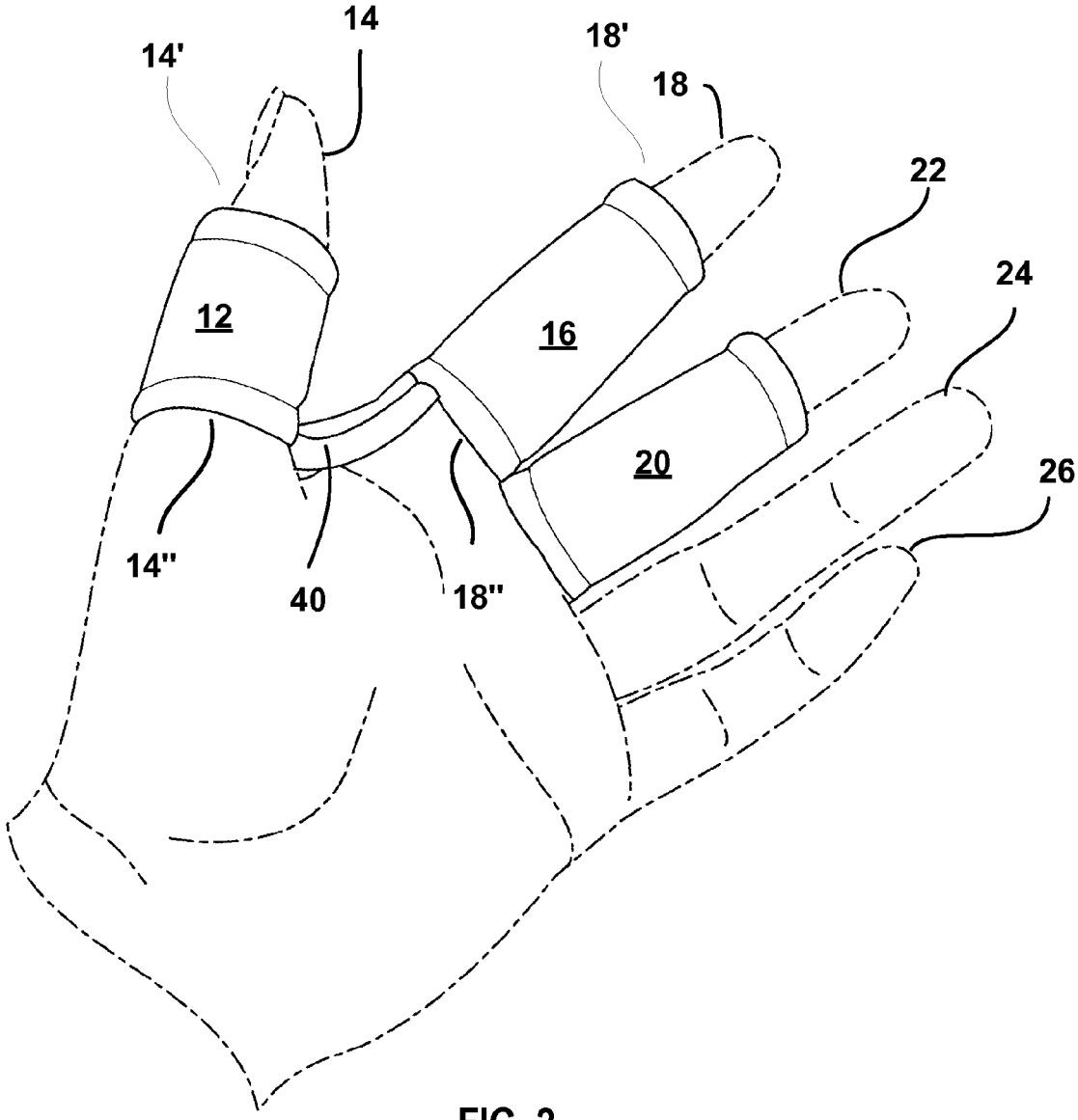
FIG. 2 illustrates a back perspective view of the glove of FIG. 1 in the environment of a hand.

FIG. 1 and FIG. 2 illustrate an example of a glove 10 for use in playing various games, such as carom billiards, pocket billiards (i.e., pool), snooker or other cue type sports. The 20 glove 10 may include a first finger sheath 12 that may cover at least a portion of a first finger, such as a thumb 14, a second finger sheath 16 that may cover at least a portion of a second finger, such as a forefinger 18 and optionally, a third finger sheath 20 that may cover at least a portion of a third finger, such as a middle finger 22, as well as other optional finger sheaths 29 that may cover additional fingers 24 and 26. The finger sheaths may leave a portion of the finger 25 exposed at the base of a finger 28 and/or at the tip of the finger 30. The first finger sheath may leave a portion of the first finger exposed at the base of the first finger 14' and/ or at the tip of the first finger 14". The second finger sheath may leave a portion of the second finger exposed at the base of the second finger 18' and/ or at the tip of the second finger 18".

In one example, the glove may include or may be limited to finger sheaths to cover at least a portion of the thumb and forefinger. In another example, the glove may include or may be limited to finger sheaths to cover at least a portion of the forefinger and the middle finger. In another example, the glove may include or may be limited to finger sheaths to cover at least a portion of the thumb, the forefinger and the middle finger. In addition, it may be appreciated that while the glove is illustrated in FIGS. 1 and 2 as being positioned on the left hand, it may be positioned on the right hand as well.

Figure 3:
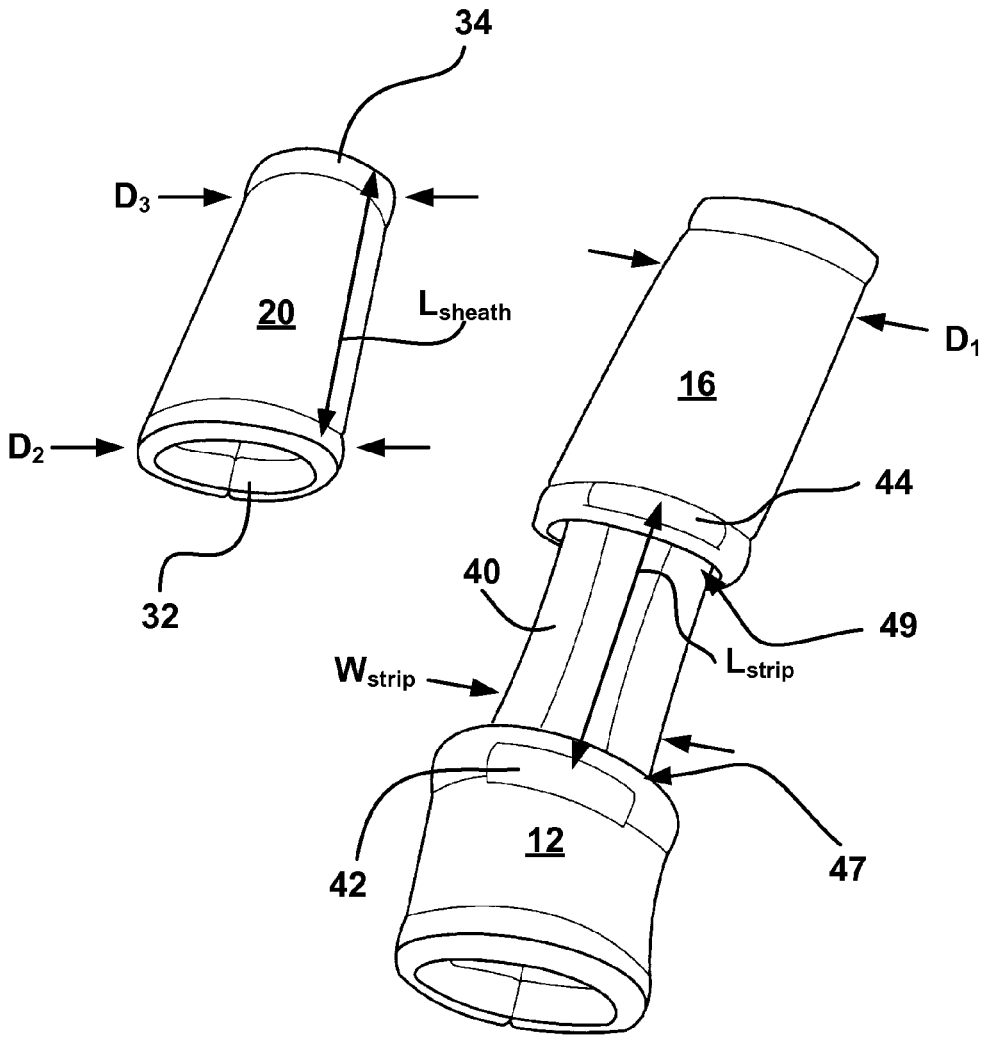
FIG. 3 illustrates a first side view of the glove of FIG. 1.

As illustrated in FIGS. 3-6, the various finger sheaths 12, 16, 20, etc., may be relatively tubular in shape defining an internal passage to accommodate a finger. In addition, each sheath in a glove system may be a number of diameters and/or a number of lengths. For example, as illustrated in FIG. 3, a sheath may exhibit a diameter $D_1$ of 1 mm or greater, such as in the range of 1 mm to 100 mm, including all values and increments therein. In addition, a sheath may exhibit a length $L_{sheath}$ of 10 mm to 100 mm, including all values and increments therein. In another example, the finger sheaths may be tapered, wherein one portion of the finger sheath 32 may have a first diameter $D_2$ greater than a second diameter $D_3$ of another portion 34 of the sheath, along at least a portion of the length of the sheath $L_{sheath}$. Each sheath in a glove system may have a different taper.

Figure 9:
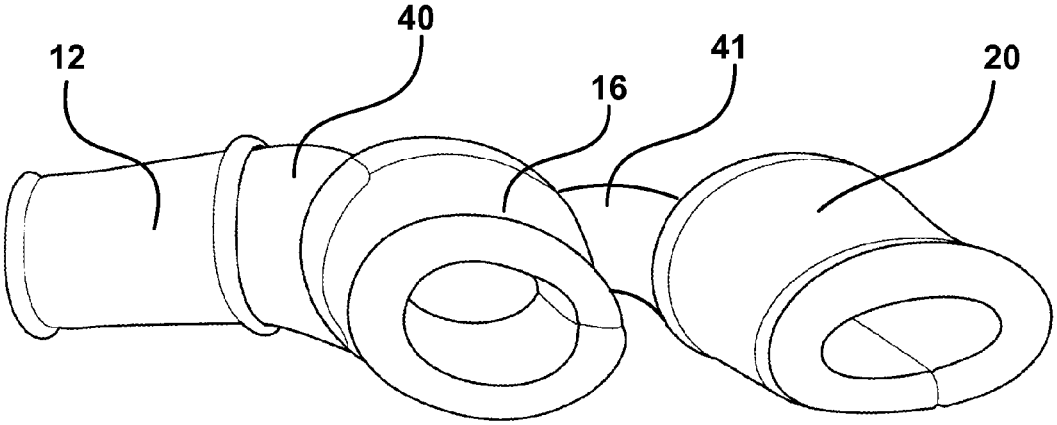

The gloves may also include a strip 40 between a first finger sheath 12, provided around a first finger, and a second finger sheath 16, provided around a second finger. An additional strip 41 may also be provided between additional finger sheaths such as between a third finger sheath 20 and the second finger sheath 16 as illustrated in FIG. 9. The strip may be of any geometry, for example, the strip may be relatively rectangular, square, triangular, etc. In one example, the strip may have a length $_{Lstrip}$ of 10 mm or greater, including all values and increments in the range of 10 mm to 150 mm. The strip may also have a width $L_{width}$ of 1 mm to 50 mm, including all values and increments therein. The strip 40 may be attached to the ends of the finger sheaths 43 45 at various attachment points 42 and 44, which may be located at or near either end (opposing ends 47, 49) of the strip.

The sheaths may be formed of one or more materials provided in one or more layers. For example, the individual layers may include one or more materials. The material may include a woven, knit or non-woven fabric, film or foam. Fabric may include, for example, nylon, polyester, acrylic, rayon, olefins such as polypropylene and/or combinations thereof. The fabric may allow for sliding engagement with a cue stick. In addition, the fabric may be relatively flexible and/or extensible allowing for the fabric to be in tension or exhibit a hoop stress when positioned on the hand. Foam or film may include, for example, polyurethane, silicone, latex, polyvinyl chloride, polyolefin including polyethylene, and/or combinations thereof. The foam may include open or closed cell foam. Open cell foam may be understood as foam wherein 40% or more of the cells interconnect or include openings in the cell walls providing communication between the cells. Closed cell foam may be understood as foam wherein less than 40% of the cells interconnect or include openings in the cell walls. In other words, at least a portion the cell walls remain intact and the cells remain discrete. The foam may also be relatively compressible. The foam may exhibit a density of 0.1 kg/cubic meter to 20 kg/cubic meter, including all values and increments therein. In addition, the foam may absorb or retain moisture and/or engage the finger in a relatively non-sliding manner.

Figure 4:
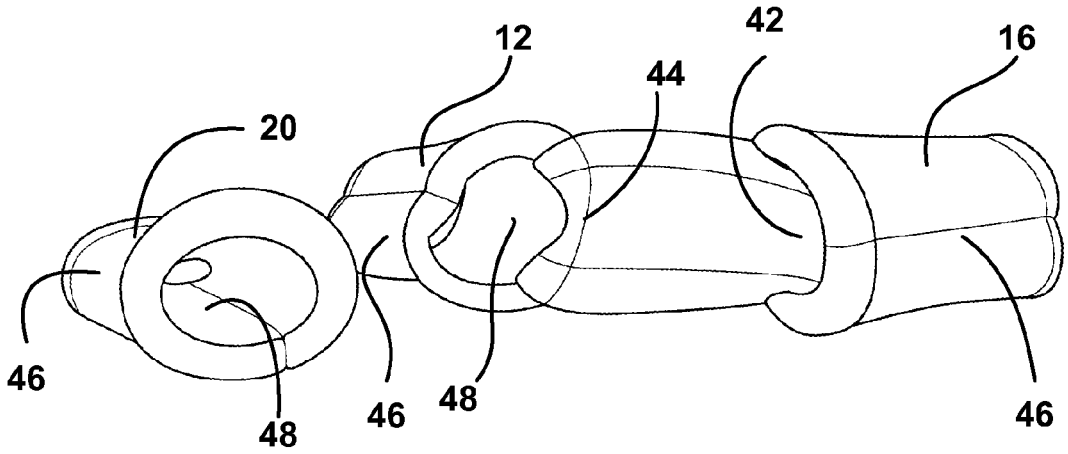
FIG. 4 illustrates a second side view of the glove of FIG. 1.

In one example, the glove may include at least two layers of material. A first layer may include a fabric and a second layer may include foam. An arrangement may be provided, as illustrated in FIG. 4, where the fabric may be positioned on the exterior surfaces 46 of the glove and the foam is positioned on the interior surfaces 48 of the glove, wherein the fabric is configured to engage a cue stick in a sliding manner, where the coefficient of friction between the cue stick and the fabric is relatively low, the foam is configured to engage the hand/fingers in a relatively non-sliding manner, wherein the coefficient is relatively high enough to prevent slippage. In another example, the glove may include at least two layers of fabric. In a further example, the glove may include at least two layers of foam and one layer of fabric. It may be appreciated that numerous variations of the layers and/or materials may be provided in the gloves. It may also be appreciated that the various finger sheaths and/or the strip may be formed of different layers and/or materials.

The various layers may be fixed together in a continuous manner, i.e., over the entire mating surfaces of the layers, or in a discontinuous manner, i.e., over discrete portions of the mating surfaces of the layers. In one example, the layers may be fixed together by an adhesive. The adhesive may be provided as a fabric, a coating, a film, a foam, etc. or the adhesive may be provided in or integral in the fabric or foam. In another example, the layers may be fixed together by mechanical interlocking, such as needlepunching, hydroentangling, sewing, etc. Examples of fabric may include headliner fabric available from JOANN FABRIC AND CRAFT STORES or DETROIT BODYWORKS.

Figure 5:
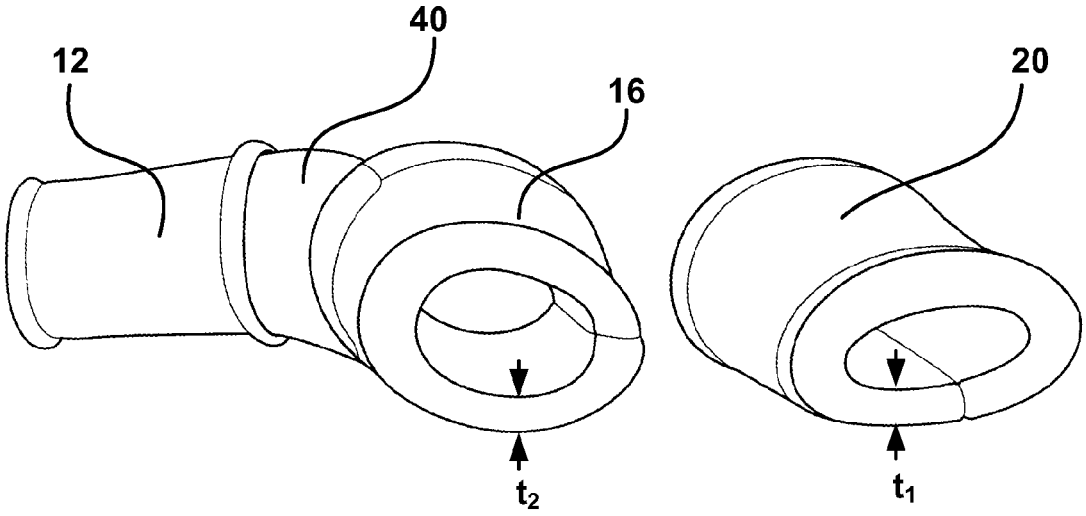
FIG. 5 illustrates a top view of an example of the glove of FIG. 1.

As illustrated in FIG. 5, the sheath material may have a total thickness t of 0.1 mm to 30 mm, including all values and increments therein. In one example, the first layer may have a first thickness that is 10% to 95% of the total thickness of the sheath material, including all values and increments therein, and at least one additional layer having a thickness in the range of 5% to 90% of the total thickness of the sheath, including all values and increments therein. In addition, it may be appreciated that each sheath may have the same or a different thickness. For example, a first sheath 20 may have a first thickness $t_1$ and a second sheath 16 may have a second thickness $t_2$, wherein the first and second thicknesses may differ.

Figure 6:
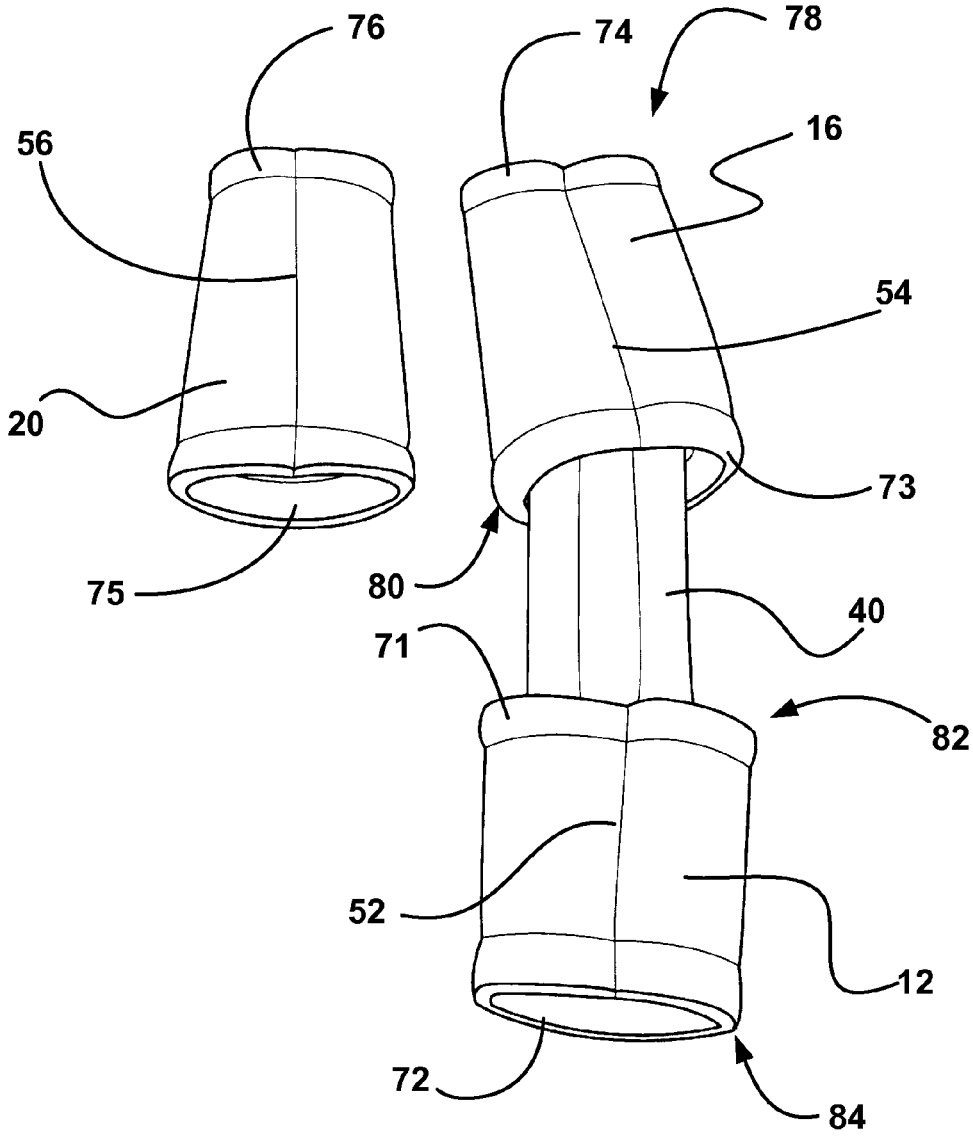
FIG. 6 illustrates a bottom view of an example of the glove of FIG. 1.
Figure 7:
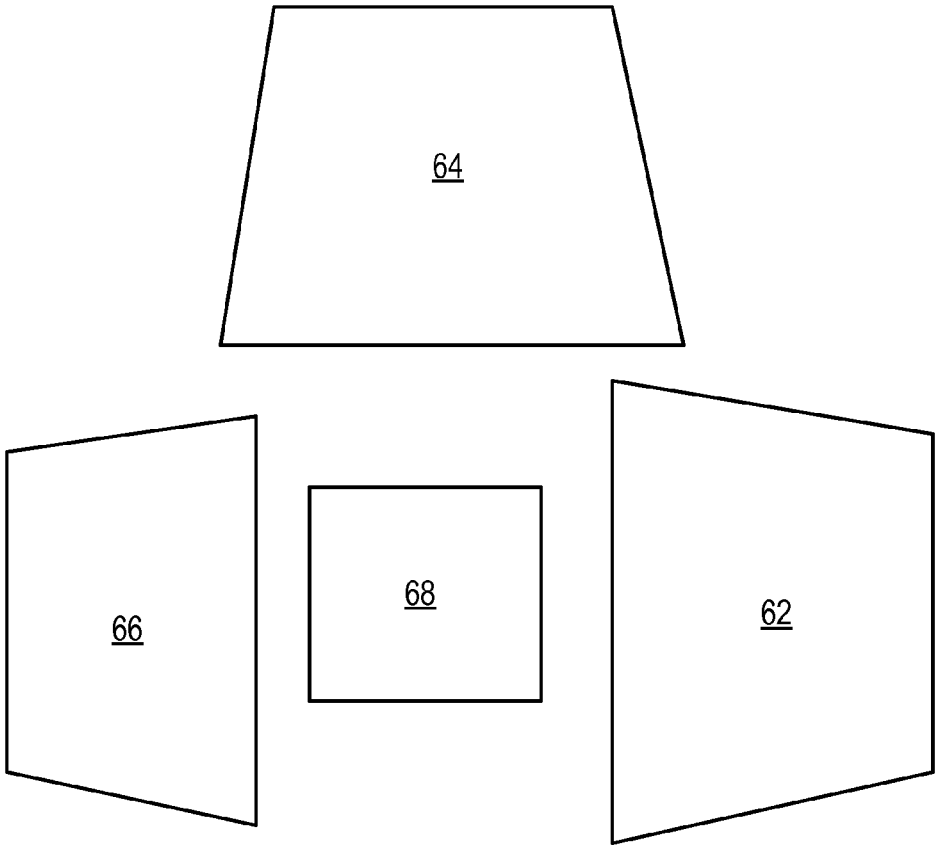
FIG. 7 illustrates an example of a pattern from which a glove may be formed.

The individual finger sheaths may be formed from sheets of material that may be cut, hemmed and sewn or otherwise affixed into tubular shapes as illustrated in FIG. 6. For example, the sheaths may be sewn together by hand or machine from a number of pieces. Seams 52, 54 and 56 may be present along the length of the sheaths $L_{sheaths}$. It may be appreciated that the seams may not necessarily be straight as depicted but may be formed in a number of manners. Various types of sewing needles maybe utilized as well, for example needles having a size of 8 to 19, including any size therebetween.

The individual finger sheaths may be formed from sheets of material that may be cut, hemmed and sewn or otherwise affixed into tubular shapes as illustrated in FIG. 6. For example, the sheaths may be sewn together by hand or machine from a number of pieces. Seams 52, 54 and 56 may be present along the length and one side of the sheaths $L_{sheaths}$. It may be appreciated that the seams may not necessarily be straight as depicted but may be formed in a number of manners. Various types of sewing needles maybe utilized as well, for example needles having a size of 8 to 19, including any size therebetween.

Referring back to FIG. 6, the pieces may have hems 71, 72, 73, 74, 75, 76 provided on opposing ends 78, 80, 82, 84 each sheath, which may be folded over and secured to, for example, the interior surface 48 of the sheaths. The folded portion may have a thickness greater than that of the unfolded portion of the sheath. It may be appreciated that the hem may prevent unraveling or degradation of the sheath material or provide additional stability to the sheath material as the glove is being pulled on or removed. The hemming may also be provided with a sufficient thickness to form a lip and catch the cue, preventing the cue from sliding towards the finger tips and out from between the fingers.

In a further example, the individual sheaths may include a closure device, such that a sheath may be formed around the finger and secured with the closure. The closure may include hook and loop fasteners, laces, snaps, and hook and eye fasteners, positioned on or proximate to opposing edges of the sheaths.

In another embodiment, the individual finger sheaths may be formed into tubes, such as by circular knitting. The strip may also be cut from sheets and/or hemmed prior to being affixed to the finger sheaths. The strip may be affixed to the finger sheets by, for example, sewing or adhesives. In such a manner, the tubes may be seamless.

Figure 8:
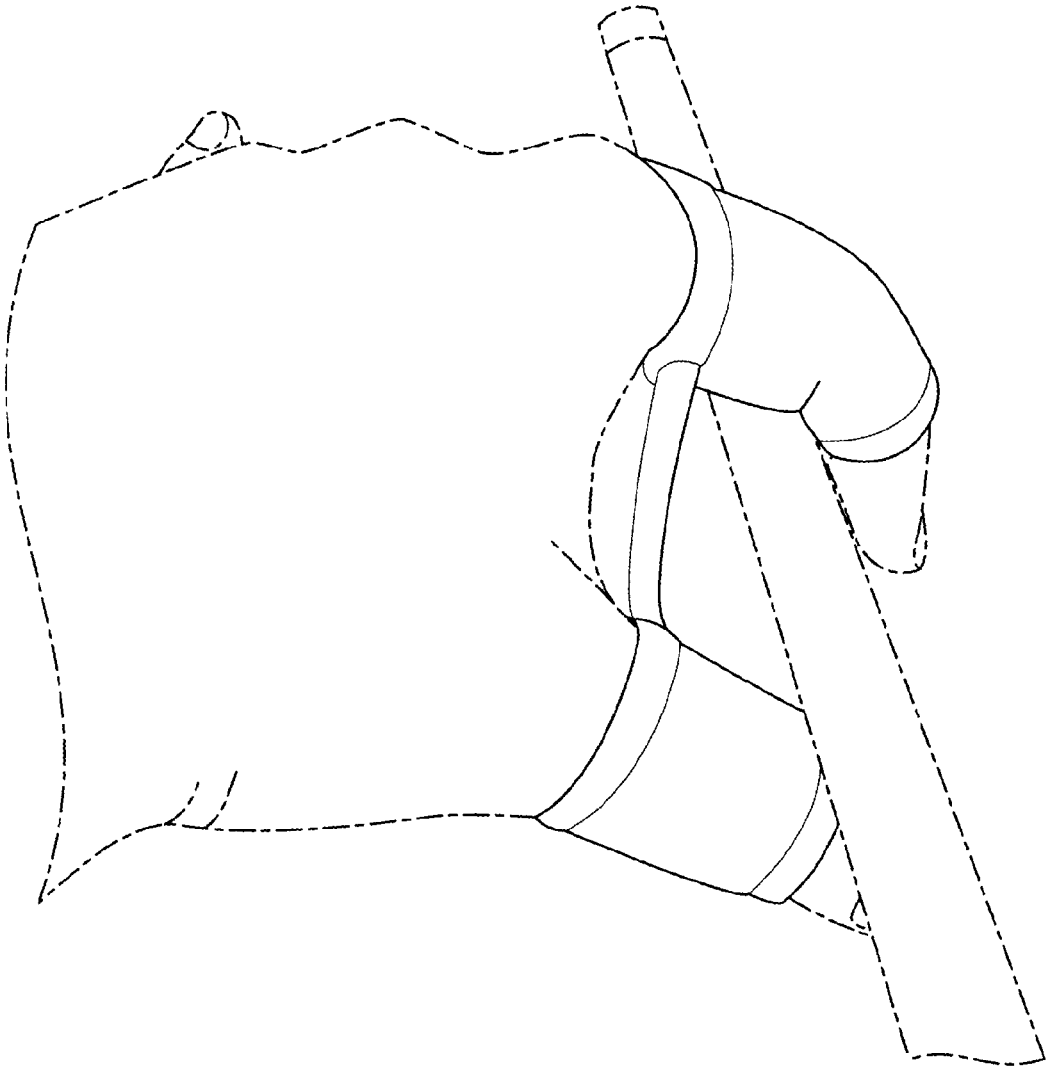
FIG. 8 illustrates a pool cue positioned within a hand including an example of a glove thereon and FIG. 9 illustrates a top view of an example of a glove.

Accordingly, it may be appreciated that, as illustrated in FIG. 8, the pool cue 100 may be positioned through the thumb 14 and forefinger 18 in sliding engagement with either or both fingers. In another example, the pool cue may be positioned or threaded through the thumb, forefinger and middle finger, wherein the cue may rest on the thumb and middle finger and may be retained by the forefinger in a sliding manner. In addition, the strip may also provide an additional support surface for sliding engagement with the pool cue.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A billiard glove, comprising:

a first tubular finger sheath including a length between opposing ends, wherein said first finger sheath is configured to cover at least a portion of a first finger and expose a base and tip of said first finger and said first tubular sheath includes an interior surface and an exterior surface;

a second tubular finger sheath including a length between opposing ends, wherein said second finger sheath is configured to cover at least a portion of a second finger and expose a base and tip of said second finger and said second tubular sheath includes an interior surface and an exterior surface;

a strip having first and second opposing ends;

a first attachment point at said first opposing end of said strip, wherein said strip is attached at said first attachment point at said first opposing end of said strip to the interior surface of said first tubular finger sheath at one of said ends of said first tubular finger sheath;

and a second attachment point at said second opposing end of said strip, wherein said strip is attached at said second attachment point at said second opposing end of said strip to the interior surface of said second tubular finger sheath at one of said ends of said second tubular finger sheath, wherein said ends of said first and second finger sheaths to which said strip is attached are adapted to be located near the base of the respective first and second fingers when said billiard glove is received on a hand, said first and second tubular finger sheaths are tapered along the entire length of each sheath, said billiard glove is formed of a material including fabric and wherein said billiard glove leaves the palm and back of the hand exposed when said billiard glove is received on a hand;

and one seam extending along each entire length of each tubular finger sheath, wherein each of said seams are circumferentially opposing each of said first and second attachment points, respectively.

2. The billiard glove of claim 1, wherein said first finger is a thumb and said second finger is a forefinger.

3. The billiard glove of claim 1, further comprising a third tubular finger sheath.

4. The billiard glove of claim 3, further comprising at least one additional strip affixed to said third finger sheath and said second finger sheath.

5. The billiard glove of claim 1, wherein said material further includes a layer of foam affixed to said fabric.

6. The billiard glove of claim 5, wherein said material has a total thickness of less 0.1 mm to 30 mm.

7. The billiard glove of claim 5, wherein said foam exhibits a density in the range of 0.1 kg per cubic meter to 20 kg per cubic meter.

8. The billiard glove of claim 1, wherein said sheaths and said strip are formed from a single continuous piece of fabric.

9. The billiard glove of claim 1, wherein said sheaths each include a hem-provided on said opposing ends of said sheaths.

10. The billiard glove of claim 1, further comprising other finger sheaths that cover additional fingers.

11. A billiard glove, comprising a first tapered finger sheath including opposing first and second ends, an interior surface, an exterior surface, and a first attachment point at one of said ends, wherein said first finger sheath is configured to cover at least a portion of a thumb of a hand and expose a tip of said thumb and said first attachment point is on said first end of said first tapered finger sheath;

a second tapered finger sheath including opposing first and second ends, an interior surface, an exterior surface, and a second attachment point at one of said ends of said second tapered finger sheath, wherein said second finger sheath is configured to cover at least a portion of a forefinger of said hand and expose a tip of said forefinger and said second attachment point is on said first end of said second tapered finger sheath;

wherein when the glove is being worn, the glove is configured to expose a palm and back of the hand and said sheaths each include two layers of fabric: a) a fabric positioned on the exterior surfaces of each of the sheaths, respectively, and b) an open cell foam positioned on the interior surfaces of each of the sheaths, respectively; and a strip having first and second opposing ends, said first end of said strip attached to the interior surface of said first sheath at said first attachment point, said first attachment point being adapted to be located near a base of said thumb and said second end of said strip attached to the interior surface of said second sheath at said second attachment point, said second attachment point being adapted to be located near a base of said forefinger and said strip has a width of 1 mm to 50 mm and a length of 10 mm to 150 mm;

and one seam extending along each entire length of each sheath, wherein each of said seams are circumferentially opposing each of said first and second attachment points, respectively.

12. The billiard glove of claim 11, wherein said external and internal layers have a total thickness of less 0.1 mm to 30 mm.

13. The glove of claim 11, wherein said foam exhibits a density in the range of 0.1 kg per cubic meter to 20 kg per cubic meter.

14. The glove of claim 11, wherein said sheaths and said strip are formed from a single continuous piece of fabric.

15. The device of claim 11, wherein said sheaths each include a seam.

* * * * *